United States Patent [19]

Wahl

[11] Patent Number: 4,773,979

[45] Date of Patent: Sep. 27, 1988

[54] EQUIPMENT FOR PURIFYING GASES AND LIQUIDS

[75] Inventor: Klaus Wahl, Markdorf, Fed. Rep. of Germany

[73] Assignee: Dornier System GmbH, Friedrichshafen, Fed. Rep. of Germany

[21] Appl. No.: 890,875

[22] Filed: Jul. 25, 1986

Related U.S. Application Data

[63] Continuation of Ser. No. 365,885, Apr. 6, 1982, abandoned.

[51] Int. Cl.[4] ..... B01D 36/00

[52] U.S. Cl. ..... 204/240; 210/243; 210/266

[58] Field of Search ..... 55/98, 318, 360; 210/748, 807, 243, 258, 284, 266; 204/240

[56] References Cited

U.S. PATENT DOCUMENTS

| | | | |
|---|---|---|---|
| 4,013,554 | 3/1977 | Reis et al. | 210/243 |
| 4,025,426 | 5/1977 | Anderson et al. | 210/284 |
| 4,196,081 | 4/1980 | Pavia | 210/284 |
| 4,474,620 | 10/1984 | Hall | 210/284 |

*Primary Examiner*—Ivars Cintins

*Attorney, Agent, or Firm*—Ralf H. Siegemund

[57] ABSTRACT

A process is disclosed for purifying gases and liquids and/or for recovering particles contained or substances dissolved therein or for implementing other technological process procedures. Technological process procedures take place in exchangeable, mobile, individual vessels (1,2,3,4) chargeable with active known substances (for instance ion exchange resins) and/or provided with technological process assemblies (for instance mechanical filters), the vessels being mutually connected and forming a reaction column (7). The vessels (1,2,3,4) filled with the same or with different substances are passed by one medium or by several separate media partial streams (X,Y). In the case of several partial streams, the media partial streams (X,Y) always pass part of the vessels (1,2,3,4) or, after mixing, the resulting media mixture (X+Y) passes the other part of the vessels (1,2,3,4). At least two media partial streams (X,Y) with mutually different pressure and temperature levels can be treated in the reaction column (7).

6 Claims, 2 Drawing Sheets

EQUIPMENT FOR PURIFYING GASES AND LIQUIDS

Figure 1:
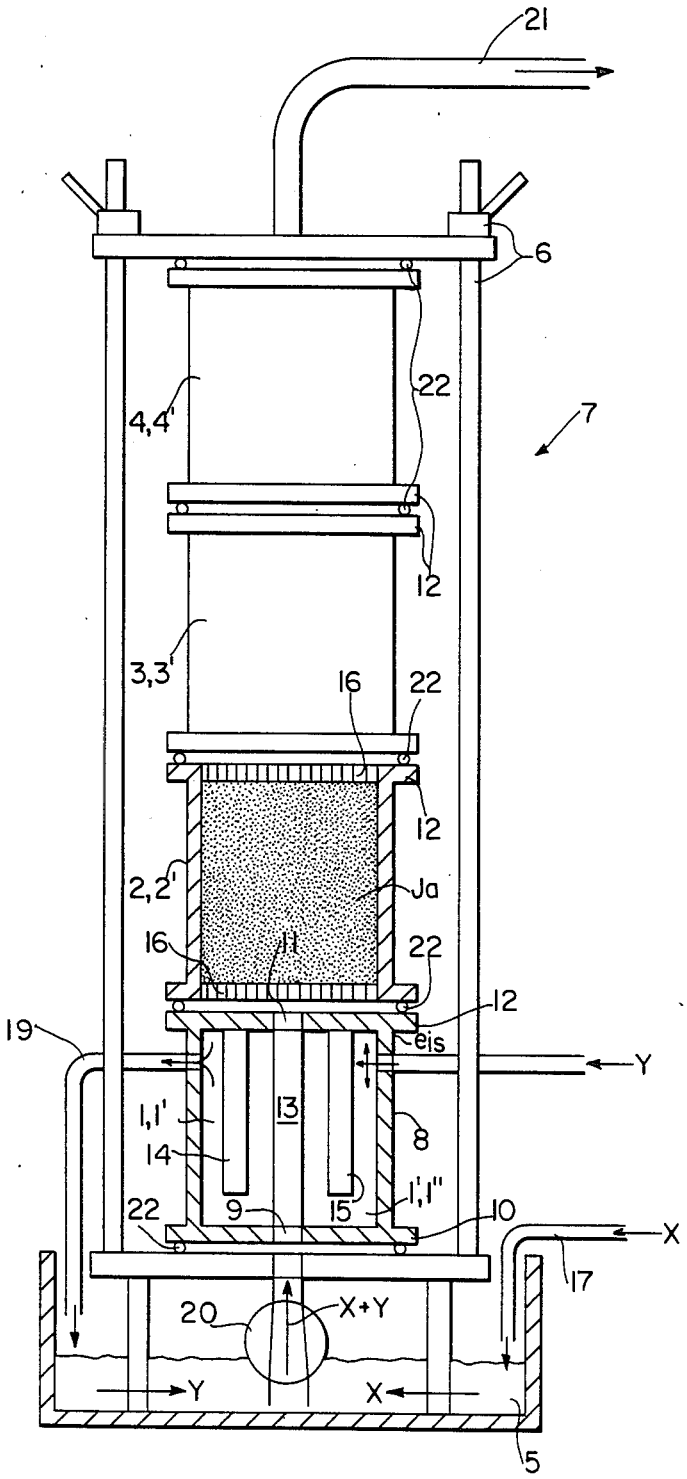

This application is a continuation of application Ser. No. 365,885, filed Apr. 6, 1982, now abandoned.

This invention relates to a process and equipment for purifying gases and liquids and/or for recovering particles contained or substances dissolved therein, or for carrying out other techological process procedures.

Ordinarily a gaseous or liquid medium passes through a series of process stages in the course of technological process procedures, wherein various chemical and/or physical reactions take place until a desired medium state is reached. This applies both to production processes and to methods for treating waste waters or waste air, or their reprocessing (for instance drinking water) and to the circulation of various materials.

Ion-exchanger plants composed of numerous vessels and connected by piping are known in practice. These known ion exchange vessels have, among other drawbacks, the fact that the individual vessels cannot be utilized at full capacity because the ion exchanger resin to be used must remain partly uncharged as a safeguard against ion breakthrough.

German Pat. No. 2,602,232 discloses equipment for recovering metals from the rinse waters in galvanizing plants, comprising at least two serial mobile ion exchange vessels and with a preceding filter, where the ion exchange vessels are arranged vertically one above the other, being covered at the top and at the bottom with a sieve and provided at the rims with peripheral seals, and also being filled with ion exchange resin.

The technological process stages (for instance mixing, separating, precipitating, and settling, among others) and the equipment used to carry them out have the drawback that these stages can be carried out only in specifically designed, separate and stationary facilities. This means that a relatively high expenditure in equipment, in space and in operation is involved.

Accordingly, it is the object of the invention to assemble these known and proven process technologies into a reaction column of mobile vessels designed as modules and filled in the same or various manners so as to carry out several process stages in one reaction column in a compact and economical manner and, where required, to exchange individual vessels, i.e., modules, or to regenerate them externally.

The advantage of the invention is that the modular design of the individual vessels filled with different substances or the same substance and consolidated into one equipment unit or reaction column achieves an extremely compact construction for the process implementation and that the equipment is adaptable in a problem-free manner to varying flow rates and problems. Together with a servicing system wherein the regeneration or reactivation of the individual modules takes place centrally, for instance as is known for ion exchange technology in galvanizing, there are applications for the individual modules together forming a system which previously were denied at least in part when resorting to some of the known process stages.

These process stages involve for instance filtering, ion exchange, electrochemical processes, mixing, catalytic processes, separations, enrichment, regeneration, precipitation, and settling. Applicable substances and structural components are respectively preferably ion exchange resins, adsorbing resins, activated carbon, kieselguhr, aluminum oxide, calcined lime, granulated peat, on one hand, and, on the other, molecular sieves, mechanical filters, membranes, electrolysis cells, and catalysts, among others.

While the individual modules of the object of the invention are arranged one above the other, similarly to the known equipment, to form a column, they differ essentially however from the known equipment in that in the invention a process is used for which the vessels are filled and with different active substances or structural members and/or that in this new process the flow take places not only in a single stream in one direction from bottom to top or vice-versa and from one module into the other, namely from bottom to lid, but rather also within the individual modules in several streams toward or from different directions. For that purpose, individual modules are provided with lateral hook-up means and/or a central feedthrough (for instance a tube) to charge the next module.

If, for instance, following pretreatment of a partial stream two partial streams are to be mixed together, then one partial stream flows through one or two first reaction modules and then will flow together with the other partial stream as a mixture through further cascaded reaction modules.

In separate stream guidance it is possible, for instance, to use one module designed as a high pressure component and the modules following as the low pressure components. The reaction modules can be designed in relatively different construction lengths and construction types. The construction length or height of the individual vessels or modules is an integral multiple or a fraction of their standard height or length in order to ensure exchanging or the possibility of a free mutual combination.

To treat, for instance, two separate streams of substances, the streams are conveyed either over clear drops or by means of externally mounted pumps.

Illustrative implementations are described below and explained in relation to the accompanying drawings, in which:

FIG. 1 shows equipment for mixing—after pretreating a partial stream—and for further treatment of a mixed stream.

Figure 2A:
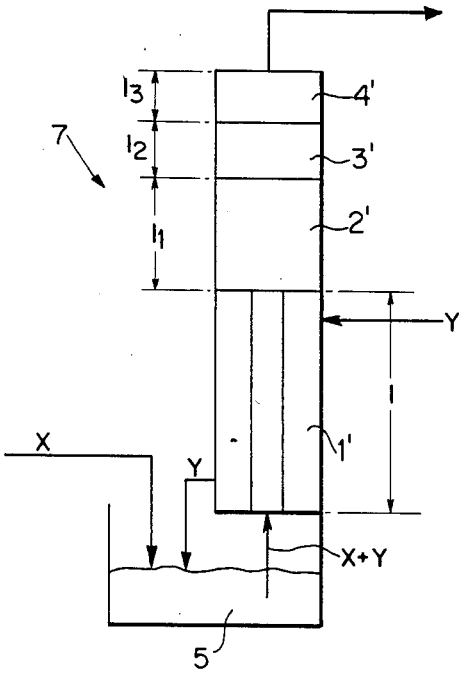
Figure 2B:
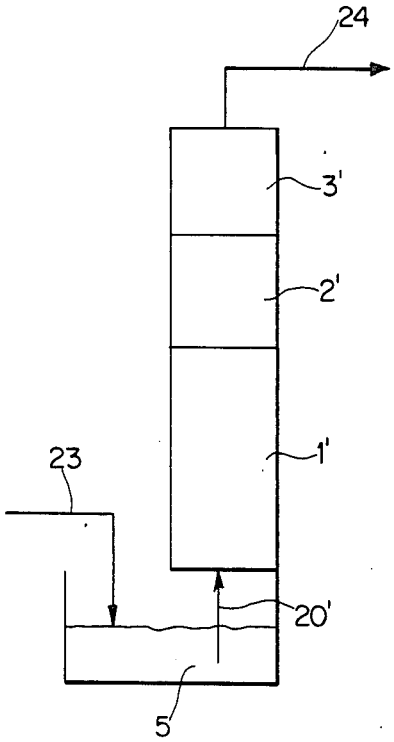
Figure 3:
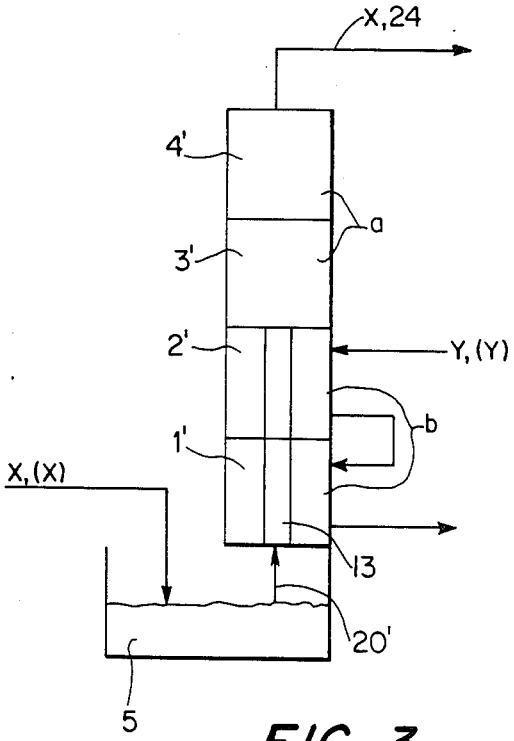

FIGS. 2*a* and 2*b* show equipment according to FIG. 1 in shematic form, with reaction modules of different construction lengths and types, and FIG. 3 shows equipment for the separate treatment of two separate streams of substances.

FIG. 1 shows a reaction column 7 composed of four vessels or modules 1, 2, 3, 4, arranged one over the other and above a bottom tub 5, held in a cage-like quick-clamp device 6, wherein two partial media streams X and Y to be treated are mixed together and subjected to technological process procedures.

Of the four vessels or modules 1, 2, 3, 4, mounted on above the other in the quick-clamp device 6, the lower one is designed, for instance, as an electrolysis module or cell 1' and on top of it are mounted, one above the other, the vessels or modules 2, 3, 4 which are coated for instance with an ion exchange resin Ja (see section of module 2). The electrolysis modlue 1 is designed as a cathode tub 1'' with an outer wall 8 and with a bottom 10 rigidly joined thereto and provided with a central bore 9. The electrolysis module 1', or the cathode tub 1'', is covered above by a lid 12 which is electrically insulated ($e_{is}$) with respect to the cathode tube 1'' and which is also provided with a central bore 11. A feedthrough tube 13 mounted centrally in the electrolysis module 1' connects the bottom 10 and the lid 12, i.e., their bores 9 and 11. Anode rods 14, 15 are mounted at the lid 12 and enter the cathode tub 1''. The vessels or modules 1, 2, 3, 4 are provided at their ends with known filter elements 16 (for instance sieves, membranes, or diaphragms, among others).

While the one partial stream X flows into the bottom tub 5 mounted underneath the reaction column 7 through a feed tube 17, the other partial stream Y is first supplied through a feed tube 18 passing through the outer wall 8 into the cathode tub 1''. After electrolysis has taken place therein, the treated partial stream Y then flows through a discharge tube 19 passing through the outer wall 8 into the bottom tub 5 where it is mixed with the partial stream X therein. The henceforth mutually mixed partial streams X and Y are forced, for instance by a pump 20 provided in the bottom tub 5, through the central feed-through pipe 13 mounted in the electrolysis module 1' or the cathode tub 1'' into the vessels or ion exchange modules 2, 3, 4 mounted above, and from there into a hooked-up line 21. The individual vessels or modules 1', 2', 3', 4' are provided with seals 22 at their junction surfaces (lids-bottoms) to prevent leakage losses of the media to be treated. Obviously the arrangement of the individual vessels or modules 1', 2', 3', 4' can be combined. That is, the partial streams can flow through various combinations. For instance, as described above, the module 1 can be designed and employed as the electrolysis cell 1', the modules 2, 3, 4 as ion exchanges Ja or the module 1' as a mechanical filter, the modules 2', 3', 4' as molecular sieves or in a manner varying from the above and with other filter and/or reaction elements known to the art.

FIGS. *2a* and *2b* show schematic equipment wherein the reaction modules 1', 2', 3', 4' are different in construction lengths 1, $1_1$, $1_2$, $1_3$ and construction types from one another when used as a reaction column 7. The construction lengths 1, $1_1$, $1_2$, $1_3$ are so selected that, for instance, the modules 2', 3', 4' following the module 1' are always smaller or shorter by half than the preceding module; thus module 2' for instance is ½ of module 1', module 3' is ½ ', and so forth. As shown in FIG. *2a*, the two partial streams X and Y can be mixed (X+Y) in the bottom tube 5, as already described in relation to FIG. 1.

Illustratively, the module 1' is an electrolysis cell, module 2' is an anion exchanger, module 3' is a cation exchanger and module 4' is another type of filler. Such an arrangement is appropriate when there is a separate flow guidance of two or more partial streams. The module 1' also can be a membrane stage for a high-pressure design and the modules 2', 3', 4' can be designed for low-pressure. There is no mixing in FIG. *2b* because the procedure is based on only one media stream. A partial stream 23 flowing into the bottom tub 5 is forced, for instance by means of a pump 20', into the module 1' designed as a candle-filter and further through the modules 2' and 3', for instance filled with activated carbon, into the line 24.

FIG. 3 shows equipment for treating two mutually separate streams of media or substances X and Y. As already described in relation to FIGS. 1 and *2a*, the partial stream X entering the bottom tube 5 is forced therefrom by the pump 20' through the feedthrough tube 13 passing through the modules 1' and 2', designed for instance as electrolysis cells, into the subsequent modules 3' and 4', for instance acting as ion exchangers, and into the line 24. On the other hand, the partial stream Y first flows into the module 2' and there by a clear drop (see directional arrow) or by an external pump (not shown in detail in the Figure) it passes into the module 1' and thence into the line 23. Illustratively, it is possible in this manner to undertake a treatment of streams of substances such as photographic baths, for instance exhausted developer (X) or exhausted fixer (Y), or a stream of fresh water (X) is made to pass through the modules 3' and 4' charged with an ion exchange resin a, and waste water (Y) is made to pass through modules 1' and 2' charged with an ion exchange resin b.

It will be obvious to those skilled in the art that many modifications may be made within the scope of the present invention without departing from the spirit thereof, and the invention includes all such modifications.

What I claim is:

1. Apparatus for purifying liquids by means of ion exchange and including a plurality of exchangeable, mobile, individual vessels arranged to establish a reaction column, at least one of the vessels being filled with an ion exchange material, the improvement comprising:

at least one other of the vessels having a lid and a bottom, the lid and the bottom each having bores, there being a flow through tube connected to the lid and to the bottom at the respective bores thereof and in sealed relation to the interior of said other vessel;

sealing means interposed between the lid of said other vessel, and a bottom of a further vessel of the vessels of the plurality of vessels, the sealing means circumscribing the bore in the lid to define a sealed flow space from the latter bore and the tube into the said further vessel;

the lower part of the said other vessel being a tub and provided for serving as a cathode;

means in said other vessel for establishing an anode that extends into the interior of said other vessel said anode and said cathode in said other vessel establishing an electrolytic cell;

first feed tube means connected to said other vessel for feeding a first partial stream of liquid into the said other vessel to undergo electrolytic treatment therein;

second, discharge tube means also connected to the other vessel for extracting electrolytically treated liquid from the said other vessel; and third means connected to the second discharge means for combining the extracted liquid with a second partial stream of liquid, the third means being further connected to the flow through tube for feeding the combined extracted liquid and partial stream liquid into the flow through tube for passage therethrough and through said flow space into a next vessel.

2. Apparatus as in claim 1 including clamping means for releasably holding all of said vessels together, the other vessel being the lowermost one in the reaction column.

3. Apparatus as in claim 1, said anode means being rods affixed to the lid and extending into the interior of the said other vessel.

4. Apparatus as in claim 1, said vessel having a bottom constructed as a filter element and being situated above said flow space.

5. Apparatus as in claim 1 said next vessel containing ion exchange material.

6. Apparatus as in claim 1, at least one of the vessels including a mechanical filter.

* * * * *